US006783331B2

(12) United States Patent
Lopes et al.

(10) Patent No.: US 6,783,331 B2
(45) Date of Patent: Aug. 31, 2004

(54) SYSTEM AND METHOD OF MULTIPLE-PHASE PUMPING

(75) Inventors: Divonsir Lopes, Rio de Janeiro (BR); Elisio Caetano Filho, Rio de Janeiro (BR)

(73) Assignee: Petroleo Brasileiro S.A. - Petrobras (BR)

( * ) Notice: Subject to any disclaimer, the term of this patent is extended or adjusted under 35 U.S.C. 154(b) by 0 days.

(21) Appl. No.: 10/223,681

(22) Filed: Aug. 20, 2002

(65) Prior Publication Data

US 2003/0049138 A1 Mar. 13, 2003

(30) Foreign Application Priority Data

Aug. 21, 2001 (BR) ..... 0103443

(51) Int. Cl.[7] ..... F04B 49/00; F04B 25/00; F04B 23/04

(52) U.S. Cl. ..... 417/216; 417/212; 417/244; 417/266; 417/426; 417/429; 417/53

(58) Field of Search ..... 417/212, 216, 417/244, 266, 426, 429, 53; 166/105, 105.5, 105.6, 369

(56) References Cited

U.S. PATENT DOCUMENTS

| | | | | |
|---|---|---|---|---|
| 2,470,794 A | * | 5/1949 | Snyder | 417/244 |
| 2,539,862 A | * | 1/1951 | Rushing | 62/230 |
| 2,698,576 A | * | 1/1955 | Strub | 417/265 |
| 3,886,813 A | | 6/1975 | Baremor | |
| 4,109,595 A | | 8/1978 | Ducol et al. | |
| 4,420,289 A | * | 12/1983 | Silhouette | 417/216 |
| 4,577,721 A | | 3/1986 | Ashikawa | |
| 5,224,836 A | * | 7/1993 | Gunn et al. | 417/14 |
| 5,253,977 A | | 10/1993 | Chaix | |
| 6,135,723 A | | 10/2000 | Hatton | |

* cited by examiner

*Primary Examiner*—Justine Yu
*Assistant Examiner*—Timothy P. Solak
(74) *Attorney, Agent, or Firm*—Nixon & Vanderhye PC

(57) ABSTRACT

A pump system for multi-phase fluids that includes a drive-shaft (11), mechanical differential units (12, 22, 23, 23', $D_1 \ldots D_n$) and pumps (14, 14', 25, 25', 25", 25'", $B_1 \ldots B_n$) where the differential units allow for the changing of pump rotation speeds between pumps(14, 14', 25, 25', 25", 25'", $B_1 \ldots B_n$) so as to adjust the compressibility of fluids in order to reduce or eliminate circulatory flow. There is also a description of the method of operating the system according to the invention.

14 Claims, 3 Drawing Sheets

SYSTEM AND METHOD OF MULTIPLE-PHASE PUMPING

BACKGROUND OF THIS INVENTION

The present invention relates to a pumping system for multiple-phase fluids. More specifically, it relates to a multi-phase pumping system that includes multiple-phase pumps with mechanical differential units, which are able to pump liquids only, gases only, or liquids and gases simultaneously in any ratio, eliminating the recirculation of fluids. The system of this invention is particularly useful in the oil industry. The invention also refers to the method used by the system put forward here for pumping multi-phase fluids.

PRIOR ART

In industry, particularly the oil industry, there are many situations in which liquids and gases are found together or mixed together, and need to be supplied with power for transporting through pipelines.

There are two distinct types of conventional equipment used to do this: pumps and compressors.

Pumps work efficiently with liquid, though not when gas is present; when gas is present the pump may cease to function, depending on the percentage of gas.

The same behaviour is seen in reverse with compressors.

Thus, if for example energy is to be transfered into a multi-phase flow in order to facilitate long-distance transport, it becomes necessary to separate the constituents into liquid and gas flows. For this op ration one uses the liquid- and gas-phase separators. In this way, following separation, the liquid flow will be directed to a pump, there to be supplied with energy and transported, while the flow of gas will be directed to a compressor for the same reason.

Generally, to work with flows of fluids at high-pressure, the separators are heavy, bulky vessels which are fitted with control and safety systems in order to maintain the correct liquid level for operation. Besides being expensive they overload the production system, especially in applications where there are limitations on space, weight or the complexity of the components installed (for example, off-shore oil-production rigs and/or sea-bed oil-production systems).

In order to do away with use of separators, industry has set about using, adapting and developing mono-phase liquid pumps and mono-phase gas compressors which can function as multi-phase pumps, pumping in two phases, liquid and gas.

Many types of multi-phase pump are under development such as: piston pumps, diaphragm pumps, single and/or multiple screw Moineau, spiral-axial, or centrifugal pumps. However, until now, none of these designs has yet reached the stage of large-scale application in industry. Those that attained the most widespread application were multi-phase twin-screw pumps and the rotary-dynamic pumps of the spiral-axial type.

A basic problem of the multi-phase fluid pump is the Circulatory Flow (C.F) of fluids, to be explained in detail later herein.

An Oscillating Chamber String (OCS), disclosed by Sulzer Pumps (Germany) in 1989–1990, is a multi-phase pump with variable capacity of the pistons which solves the C.F. problem, though in a more complex way than that adopted by the present invention. The OCS piston pump has a positive displacement action. The pistons and connected sheaths connected in a set produce a multiple-stage pump.

The travel of each piston is variable. A control-system and motors connected to each piston reset the piston's travel, so as to maintain equal pressure increments in the component stages of this design.

A twin-screw pump is normally used to pump liquids, at which it gives good performance, and it has been adapted to serve as a multi-phase pump. This is also a positive-displacement pump, made up of two metal screws and two metal sheaths, producing cavities of equal volume, which move by suction to discharge the pump, in order to drive the fluids. The screws and sheaths form metal seals between the cavities; in other words, each cavity demarcates a stage of the pump.

The twin-screw pump displays the following disadvantages, brought about by the phenomenon of Circulatory Flow (C.F.):

1. durability is reduced through the increased proportion of gas;
2. energy-efficiency is reduced through the increased proportion of gas, possibly declining to zero;
3. it is unable to pump high proportions (for example, over 95%) of gas, or gas alone.

There follows a description of C.F. and its effects.

The mono-phase gas compressor has variable volumes at each stage, being unable to pump liquid, hence an Excessive Rise in Pressure (E.R.P.) would arise at each of its stages. In order that the liquid will be pumped while avoiding E.R.P, the twin-screw pump exhibits stages or cavities at constant volumes. Hence, there would be no reduction in the volume of gas entering the cavity, so pressure would not rise. Thus, suction pressure would be maintained in all pumping stages, and discharge pressure would increase only at the final stage, when the cavity communicates with the pump discharge. This is certainly not what actually happens, since the final stage does not resist any increase in the required pressure. If it did resist, there would be no need for an extra stage.

Single-stage pumps do not present this problem, since the single stage resists any increase in the pressure required.

Under the law of conservation of mass, the flow-mass must be constant at all stages of the twin-screw pump. Fluid pressure rises while the cavity is moving; in other words, pressure rises from one stage to another. With that rise in pressure, the volumetric flow of fluids declines, allowing a state of gas equilibration, and as a result it cannot succeed in completely filling the cavity. Thus, it is filled up with fluids which will not normally drain away. Those fluids that remain in place, occupying cavity spaces that pass through them, represent the C.F. of the fluids.

By way of illustration, let us suppose a twin-screw pump with several stages, compressing gas with a pressure value of 1 Absolute Unit of Pressure (AUP) of suction and 10 AUP of discharge. The volumetric suction gas-flow is at its maximum whereas, when discharged, this flow declines to 1/10 of the volumetric gas flow in the first cavity. Consequently, 9/10 of this volumetric flow will need to be supplemented by fluid originating in C.F: in other words, this 9/10 of the fluid continues to occupy the cavity, moving to the previous cavity, as long as this continues to occupy the position of the last cavity.

This same phenomenon occurs with the remaining cavities; however, the C.F. will be lower, since it depends on the relationship between the cavity and pump suction.

The return, or greater C.F., occurs at the final cavity where there is greater pressure, and the smaller C.F. at the first where there is less pressure. However, linear distribution of pressure does not occur, because the return flow, being much greater in the higher stages, is impeded by the clearances found between the cavities. Therefore, in the presence of gas, the higher stages function with a greater Rise in Pressure, or greater E.R.P.

The twin-screw pumps are installed with a minimum clearance between the screws and sheaths, when they function as virtually non-compressible liquids. These pumps are not multi-phase and do not compress gas, because an E.R.P. would arise at the stages. In order to make them multi-phase, designers reduce the E.R.P. increasing the clearance between screws and sheaths so that the remaining stages will function.

Supposing a discharge of a liquid pump should be linked to its own suction by means of a choke or control valve, so that 90% of the pumped flow returns. If the hydraulic power of the pump were 10 Units of Power, 9 of those units would be dissipated at the choke in the form of heat. If the choke did not exchange heat with the environment (considering that this is an adiabatic process), the result is equivalent to installing a heater with the same 9 units of pump-suction power, in order to heat just 10% of the flow passing through the pump. However, the return of fluids at the twin-screw pumping stages causes overheating, similar to the overheating caused by the choke when working under an adiabatic régime.

Fluids that return without leaving the interior of the twin-screw pump cannot cool it down, because each time they return, they are heated on passing through the hydraulic sealing areas of the cavities.

Experimental data on twin-screw pumps having more than one stage shows that the total power consumed by the pump does not depend on the volumetric gas ratio. This phenomenon occurs not only in single stage pumps, since the power declines greatly while the volumetric ratio of gas rises. C.F. accounts for this phenomenon.

When there is only liquid, hydraulic power is around at most 75% of the total energy consumed by the pump. Therefore it reduces the ratio of gas linearly, to zero (0%).

When there is only liquid, heat generated by the pump is caused by physical friction, in the order of 25% of total energy consumed by the pump. Therefore heat increases linearly with the ratio of gas, owing to C.F. of fluids and gas compression, until reaching a maximum value equal to the pump's total power (100%) when there is only gas. In other words, the heat generated increases approximately fourfold, while cooling of the pump is greatly reduced, since the thermal capacity of gas is far lower than that of liquid.

When there is only gas and the compression ratio is 1 to 10, heat generated by gas compression, physical friction and C.F. is in the order, respectively, of 20%, 25% and 55% of total energy consumed by the pump. Its energy-efficiency is obtained by the compression effort, which is roughly equal to the heat generated by compression; in other words, energy-efficiency is in the region of 20%.

When the compression ratio is 1 to 100, heat generated by gas compression, by physical friction and by C.F. is in the order, respectively, of 3%, 25% and 72% of total energy consumed by the pump. Energy-efficiency is in the order of 3%. C.F. is responsible for the greater proportion of energy dissipated.

Apart from overheating and poor energy-efficiency, E.R.P. and C.F. cause, respectively, distortion and excessive decay of the pump's screws and sheaths.

E.R.P. can be prevented by increasing the clearance between screws and sheaths, to facilitate C.F. However, overheating, low energy-efficiency and decay cannot be prevented with this type of pump. Differentiated gaps reduce the rise in pressure at some stages, but increase the rise in pressure at others. Larger clearances reduce pressure increases, but increase the number of pump stages. However, in neither case are these unwanted effects avoided altogether.

Multi-phase pumps made with high clearances to prevent E.R.P. also have the disadvantage of failing to work when there is C.F. of low-viscosity fluid, which produces little difference in pressure between stages. This happens mainly when there is a high proportion of gas.

Generally speaking, overheating restricts the operation of multiple stage pumps to gas levels below 90%. Above this level, the liquid portion is insufficient to cool the pump down. Nevertheless, E.R.P. (which causes distortion) and C.F. (which causes decay) restrict the application of the pump even more, to gas values below 20%, namely to values close to the permissible drainage when pumping only liquid.

These factors apply equally to other types of pumps with more than one stage, but not to single-stage pumps.

Consider a single stage twin-screw pump with suction pressure of 1 Absolute Unit of Pressure (AUP) and discharge pressure of 10 AUP. The cavity is filled up with fluids at 1 AUP while open for suction. As long as the screws continue rotating, the cavity communicates with the discharge, initially through a small opening. The fluids from the discharge will return into the cavity, compressing the gas until the 10 AUP pressure level is reached. In the process, little energy is dissipated in the form of friction, because fluids do not return, straining the seal. Friction is very slight, because the cavity opens so that fluids return without any difficulty. Energy is converted mainly from pressure into kinetic energy and vice-versa. Following this return, movement is started up and fluids will leave the cavity, as long as the cavity diminishes.

In the presence of gas, it turns out that single stage pumps display C.F, with no loss of energy-efficiency. Therefore, multi-phase pumps are more efficient in terms of energy and durability than a single stage.

Single stage pumps, or any other pump with more than one stage, installed in such a way that forced C.F. does not take place, will work at any gas ratio since there is no E.R.P. or decay, and also less heating.

An example of a multiple stage pump installed to avoid C.F, is the OCS positive displacement piston pump. With the aim of maintaining an equal increase in pressure at all stages of this pump, a complex system of measurements and pressure controls is necessary to activate the motors which reset the piston travel.

Nonetheless, OCS piston pumps display the following disadvantages:

1) there is E.R.P. and C.F. while the response time of the control-system is slow compared with changes in the proportion of gas, especially when there is intermittent drainage in the pipework supplying the pump;
2) there is poor reliability, due to the complexity of the control system;
3) there is higher energy consumption, due to the motors which change the piston travel.

E.R.P. and C.F. occur both in compressors with more than one stage at which they pump liquid, and in pumps with more than one stage (piston, diaphragm, single- and/or multiple-screw, Moineau, gear, spiral-axial, centrifugal, etc) when they compress gas. Resolving the problem of E.R.P. and C.F. in these pumps equates to solving the same problems in such compressors; in other words, the difficulties of converting a liqiuid pump into a multi-phase pump are the same as those involved in converting a gas compressor into a multi-phase pump, because E.R.P. or C.F. are inevitable in all these fluid machines.

Fluid machines are devices that supply (pump, compressor, ventilator, extractor-fan, ejector energy to fluids) or receive (water-wheel, Pelton turbine, Francis turbine, wind-tunnel) energy from fluids. These are also known as flow machines.

Nonetheless, despite all the new developments, these mono-phase pumps are not entirely suitable for multi-phase fluids, since they are not multi-phase pumps and do not apply multi-phase principles; in other words, they cannot be properly adapted to the variable compressibility of multi-phase fluids. Finally, they do not show variable volumetric flow at each stage.

Positive displacement pumps of the OCS type give better performance than that of mono-phase pumps, currently under development for use in multi-phase service, as they do not show the unwanted effects of E.R.P, nor of C.F.

However, when these are compared with pumps that work only with liquid and compressors working only with gas, existing multi-phase pumps display at least one of the drawbacks already mentioned in the present specification for twin-screw pumps.

Depending on operational requirements, these disadvantages greatly restrict the application of most existing multi-phase pumps. Even for small and medium quantities of gas, the possible occurrence of intermittent drainage (separate receptacles for gas and liquid) in the supply pipework can restrict the scope of application of these multi-phase pumps even more. The literature reveals various patents relating to pumps for multi-phase effluents.

U.S. Pat. No. 5,253,977 describes an axial pump which makes possible the pumping of a fluid with a dual liquid-gas phase at high flow-rates. It consists of a single-part rotor including a hollow shaft, inside which there is a pulsating contraction system (rotor and diffusor). This system is installed inside a unit comprising a stack of washers, inside which stretchers are fixed. Each stretcher is made of two half-stretchers, in such a way as to allow each stretcher to be installed in the rotor wheel. The whole is sealed by flanges at the edges, on which the rotor is mounted for rotating. The pulse system can also be manufactured on the external surface of the unit.

This US patent makes no claim to be a new method of multi-phase pumping, since it is concerned with a pump of the axial type, widely used in industry, especially for mono-phase pumping of liquid and gas. What it does claim to be is a new method of manufacturing this pump, so that the rotor shaft unit will be pre-balanced, minimizing vibration caused by this unit. However, vibration caused by the heterogenous mass of multi-phase fluid, at varying density phases, still occurs.

U.S. Pat. No. 6,135,723 describes a multiple-stage pump with a housing that defines multiple stages, each stage having an internal rotor-box, each box having an input and output for which there are no pumps. A rotor unit is contained inside the housing: under operational conditions, this housing extends right through all the stages. The rotor units and their boxes are made so as to give a volumetric entry supply rate at the final stage (downstream current or output) that is less than that of the first stage (upstream current or input). Multiple fluid channels connect the non-pumping chambers in order to allow the pump to drive the liquid in such a way that, as the rotor unit rotates, a current of fluid entering the pump input will be subjected to pumping action to move the flow of fluid to the output through the pump's output.

This pump does not prevent circulatory flow and its attendant drawbacks: poor energy-efficiency, excessive rise in pressure (E.R.P.) and excessive decay. These problems are partly transferred outside the twin-screw pump.

In conventional twin-screw pumps, circulatory flow (C.F.) occurs between the rotors or screws and the pump sheath, damaging them in the process. In U.S. Pat. No. 6,135,723, part of C.F. occurs outside the pump itself.

The remaining C.F. occurs inside the pump, between the stages or screw passages between the areas without a screw, in the same way as happens in conventional twin-screw pumps. In order that no C.F. will occur, there cannot be more than one stage between the areas without a screw.

The fact that the pump's discharge stages will be fewer than the suction stages prevents or reduces C.F. when more gas is coming in. However, C.F. remains greater when more liquid is entering.

Hence, this patent fails to resolve the main problems of C.F.; namely poor energy-efficiency and decay. It merely reduces one problem: the rise in pressure. The low energy-efficiency and decay still persist and are caused by C.F. in the pump's external fixtures (pipes, valves, accumulators and auxiliary pumps).

On the other hand, the patent literature mentions differential-action units for automotive systems. These units are used in the motor industry to distribute the energy of a shaft from the engine to each axle connected to a wheel, in accordance with U.S. Pat. No. 3,886,813 and U.S. Pat. No. 4,577,721 among others.

U.S. Pat. No. 4,109,595 describes a multiple-differential used in the textile industry.

The differential-action unit is a simple device, with few gear wheels (normally four). In the case of a motor vehicle it allows the wheels to rotate at the same speed on the straight but at different speeds on bends; in other words, wheels on the inside of a bend rotate more slowly than those on the outside, i.e. while they are covering different distances. Both on the straight and on bends, torque is distributed equally to the wheels. The differential-action unit swiftly fulfils this function, accurately and automatically, and more efficiently than other systems. Hence it is used in most motor vehicles.

In accordance with the concept of this invention, a differential may, on being coupled to a pumping system, cause the volumetric fluid flow being pumped to change, thus reducing the fluid's C.F.

U.S. Pat. No. 2,698,576 (Strub) describes a pumping system for liquids that makes use of mechanical differentials. The Strub system is used for pumping of high pressure liquids, around 3,000 atm. This solution has not been used in the industry because the mechanical differentials are unnecessary for use. This pumping is easily obtained without differentials, decreasing the volumetric capacity in each series stage of the pump, according to the liquid compressibility, as the pressure goes up. The dimensioning of this pump for liquid in high pressure, without mechanical differentials, is similar to the dimensioning of as compressors with more than one stage in series. In respect to the compressor, the low compressibility of the liquid results in lesser difference between the volumetric capacities of the pump stages, while the high compressibility of the gas results in greater differences between the volumetric capacities of the compressor stages.

Thus, technology relating to multi-phase pumps still needs to be further refined in terms of pumping efficiency, particularly with regard to fluid recirculation and C.F. aspects. Such refinements include the Multi-phase Pump with differential units, giving low or zero C.F, described and claimed in the present application.

SUMMARY OF THE INVENTION

The multi-phase pumping system according to the invention is defined in claim 1. It may include a housing enclosing the multi-phase pump unit, a differential unit and multiple stages, united by means of shafts, the first of these being the driving-shaft, which is rotated by a motor. This drive-shaft activates a differential unit, which in turn rotates the next two shafts which drive the first two pumps connected in a set, the differential units providing the necessary rotation compensation, so that each pump displays a variable volumetric flow, controlled by the compressibility of the fluid, such that the C.F. of that fluid is reduced or altogether eliminated.

By comparison with pumps that work only with liquids and compressors working only with gas, existing multi-phase pumps display at least one of the following drawbacks: great complexity; durability that is reduced with increases in the ratio of gas; and reduced energy-efficiency with increases in the ratio of gas, tending down to zero. They will not pump high proportions of gas, or gas alone.

The Multi-phase Pumping System in accordance with the invention reduces or eliminates C.F. This is achieved through the use of mechanical differential units, and has the aim of pumping only liquid, only gas, or liquid and gas simultaneously in any ratio, without producing any of the previously-mentioned drawbacks. The use of mechanical differential units provides a simple way of substantially reducing or totally eliminating C.F, which is the main source of these shortcomings.

Also, under the operating method deployed in this pumping system, a drive-shaft activates the differential unit which, in turn, rotates the shafts which activate pumps arranged in a set. In order to be pumped, multi-phase fluid, liquid or gas in any proportion enters through the suction pipe of a first pump where the pressure rises, it passes to the discharge pipe of that pump, and enters through the suction pipe of a second pump where there is a further rise in pressure, and finally leaves through the discharge pipe of the second pump.

When the fluid is liquid alone, both pumps at each stage rotate at the same rate, to produce equal volumetric flows. Therefore, the multi-phase pumping system according to this invention for reducing or eliminating C.F. works analogously to the wheels and differential unit of a vehicle running in a straight line.

As used above, the word "stage" has the following meaning. When pumps are arranged in a set, each pump represents one stage, since each causes an incremental step-change in pressure. Hence, the increments in pressure at each pump are cumulative, and the mass of fluid passing through the two pumps is identical.

Yet when the pumps are in parallel, the mass of fluid passing in each pump increases, while the pressure does not. In this situation there is just one stage, since there is hardly any increment in pressure set by the suction and discharge pressures, which are equal for all pumps.

When any proportion of gas enters, the volumetric flow of the second-stage pump remains less than that of the first-stage pump, because gas is compressible, and pressure at the first stage is lower than at the second, as the pumps are linked into a set. The pump-shaft of the first stage rotates more rapidly than that of the second, since the differential-action unit makes the necessary rotation compensation, in the same way as do the wheels of a vehicle rounding a bend.

The invention envisages further pumping systems with more than one differential-action unit, in order to produce more than two pump stages.

The invention also provides a multi phase pumping method as defined in claim 12.

Systems with one or more multiple-differentials are also envisaged for the invention.

DETAILED DESCRIPTION OF THE PREFERRED EMBODIMENTS

As used in the present specification, a flow containing oil, water and gas is described as being "multi-phase". The flow might even include sediments.

"System" means all components in their entirety: motor, pumps, differentials, shafts/axles interconnecting those components, bypasses, brakes, accumulators, valves and other parts that make up the system according to the invention.

The pump may have one or more stages. In this invention, although not essential, it is preferable to use one-stage pumps as they are multi-phase; in other words, they do not display C.F.

For one pump, each stage represents an incremental increase in pressure, as the increase in pump pressure does not occur continuously along the pump: there is an increment from one cavity to another. The amount of the increment depends on the demands made of the pump; in other words, the difference between the pump's discharge and suction pressures. This value also depends on to what extent the seal between two cavities supports pressure increments; in other words, to what extent the seal offers resistance and shuts off hydraulically.

Thus, in the first place, the present invention relates to a pumping system for multi-phase fluids, in which fluid recirculation or C.F. is either zero or reduced.

The invention will now be described with reference to the accompanying drawings, which are merely by way of illustration and should not be seen as limiting the invention.

Figure 2:
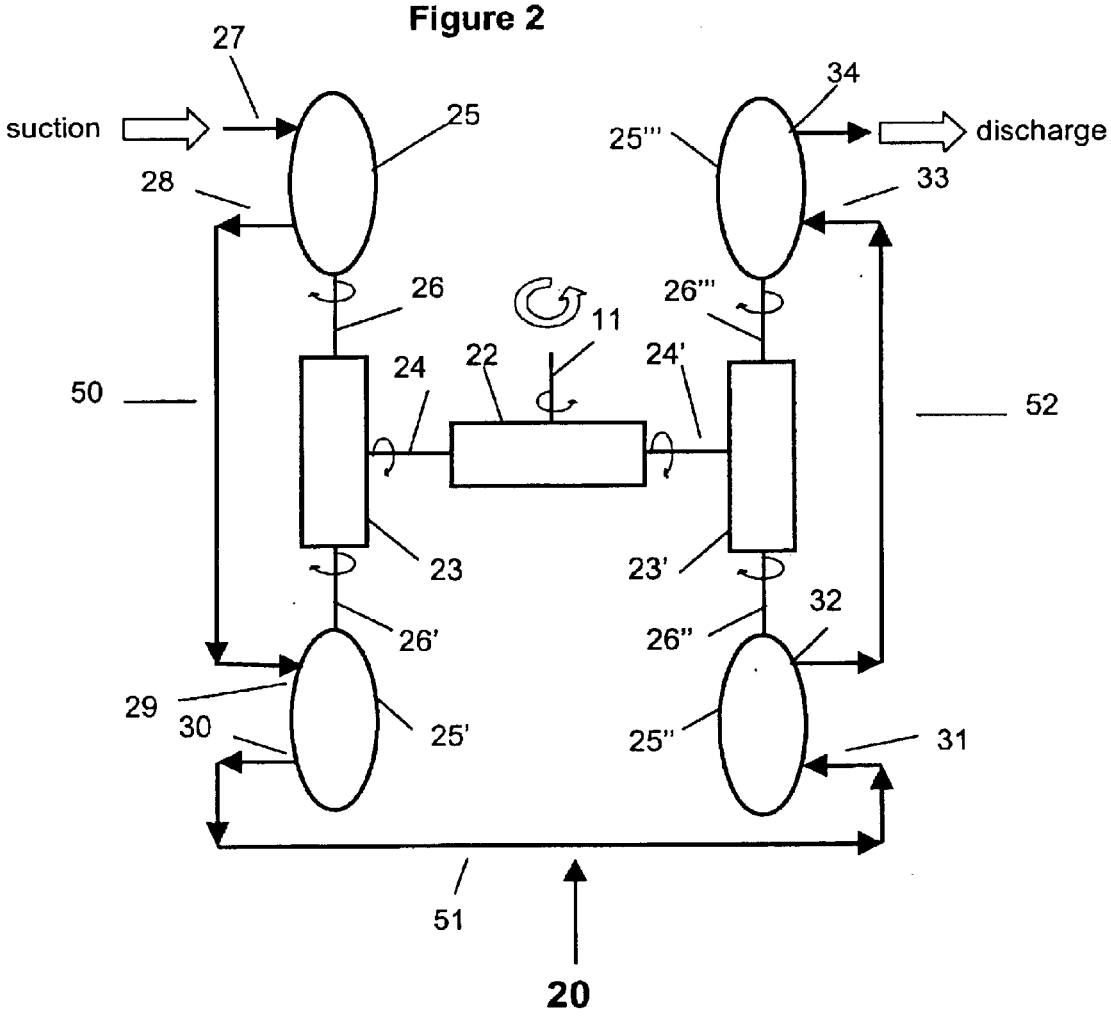
FIG. 2 illustrates a different embodiment with three differentials and four pumps.
Figure 3:
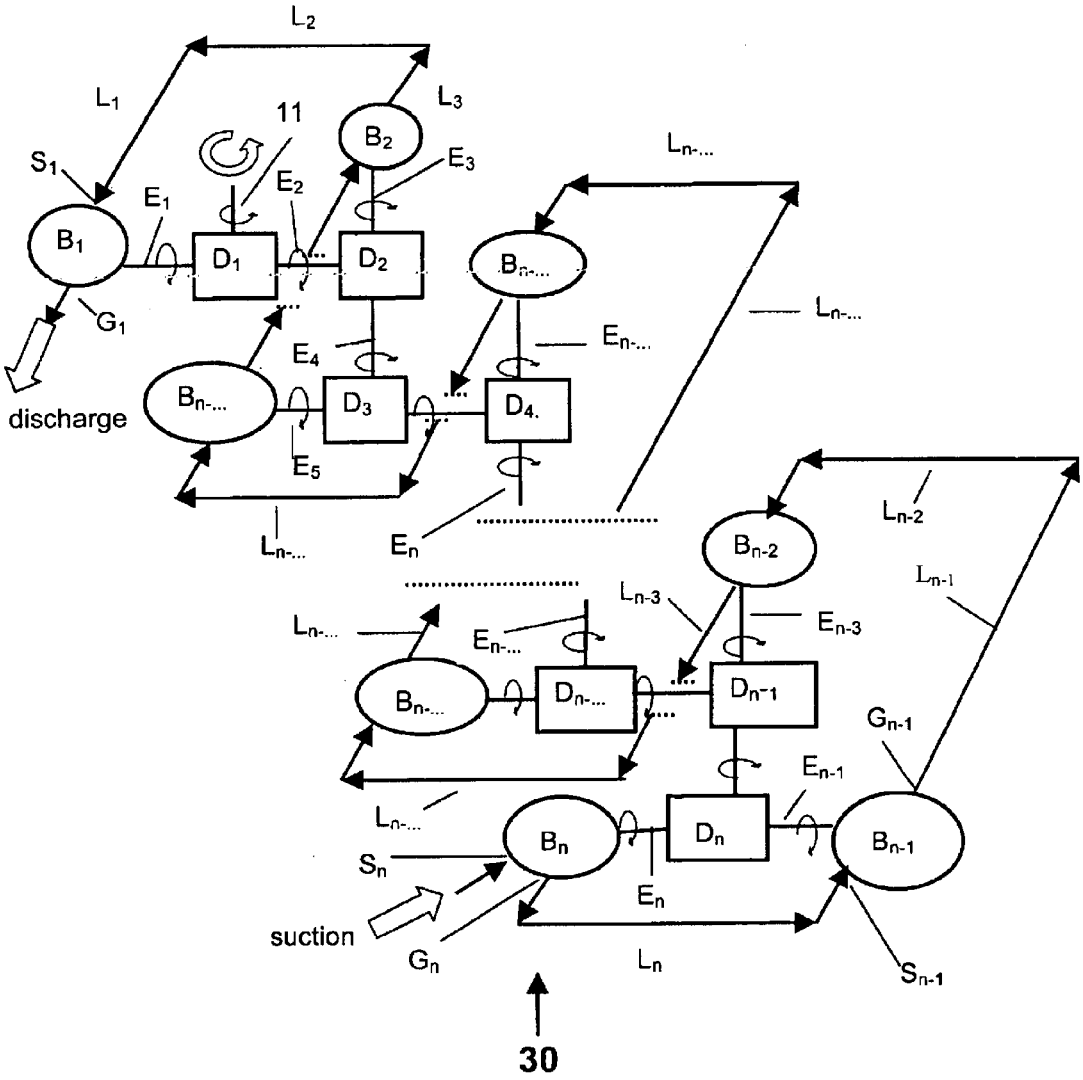
FIG. 3 illustrates a generic example of the invention with n pumps and n−1 differentials.

According to the invention, the arrangement of pumps and differentials of the pumping system proposed falls into one of two types: symmetrical (FIGS. 1, 2 and 4) or asymmetrical (FIG. 3).

Figure 1:
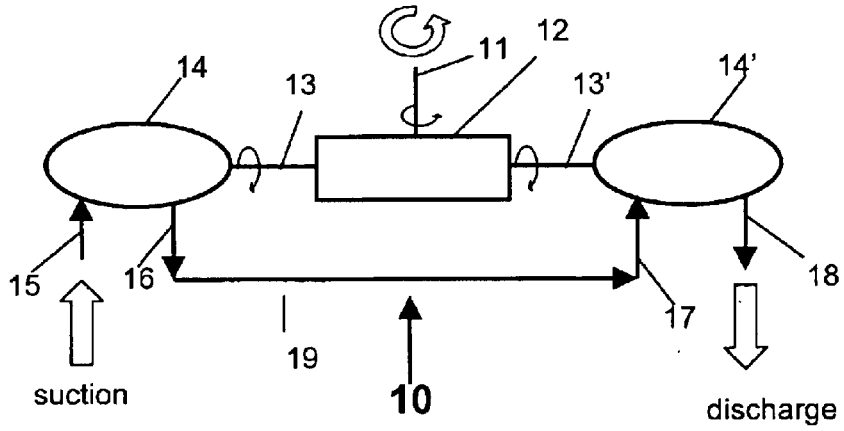
FIG. 1 illustrates an embodiment with one differential and two pumps.

FIG. 1 illustrates a multi-phase pumping system 10 with a differential unit and two pump stages. The drive-shaft 11 is connected in the conventional differential unit 12 to two activating shafts 13, 13' of the two pumps 14, 14' which form its two stages.

The system 10, as well as the other embodiments, is contained inside a housing shell, not shown here.

The drive-shaft 11 is rotated by a motor, not shown in FIG. 1. The drive-shaft 11 activates the differential unit 12 which, in turn, rotates the shafts 13, 13' which activate two pumps 14, 14' linked into a set.

In order to be pumped, multi-phase fluid, liquid or gas in any proportion enters through the suction pipe 15 of the pump 14, where the pressure rises; it passes into the discharge pipe 16 of the pump 14, runs through the linking or collection conduit 19 and then enters the suction pipe 17 of the pump 14', where there is a further rise in pressure. Finally, the multi-phase fluid leaves through the discharge pipe 18 of the pump 14'.

Pumps 14, 14' are conventional piston-type, diaphragm type pumps, single- and/or multiple-screw Moineau, gear, helico-axial or centrifugal pumps. However, they should ideally have only one stage, so that no C.F. will occur.

There is a parallel between the present multi-phase pumping system and the above mentioned U.S. Pat. Nos. 3,886,813 and 4,577,721. When the fluid is only liquid, both pumps 14, 14' operate at the same volumetric flow, as liquid is virtually incompressible. They work similarly to a vehicle running in a straight line with its wheels rotating at the same speed; in other words, both pumps making up the stages rotate at the same speed.

Pumps 14, 14', may be of the same size or different sizes.

If the pumps are of the same size, they must rotate at the same speed to produce equal volumetric flows. It turns out that, in the presence of liquid alone, the multi-phase pumping system of this invention works analogously to a vehicle running in a straight line, with its wheels rotating at the same speed; in other words, the two pumps comprising the stages rotate at the same speed.

Should the pumps 14, 14' be of different sizes, they will also function without any problem. The smaller pump will rotate faster than the larger, so that their volumetric flows will remain equal. Analogously, a vehicle normally runs in a straight line, even if its wheels are of different diameters, since the differential-action unit makes the necessary rotation compensation. However there does exist a drawback, namely that the smaller wheel will skid more than the larger.

Even in a straight line, in a vehicle with no differential unit, with wheels of different diameters, the larger wheel controls the rotation of the smaller; in other words, the smaller wheel skids as if it were being lightly braked, causing excessive torque on the axles and wearing down the tyre.

In a vehicle with a differential unit, in one scenario, it is possible to use wheels of different diameters without any major problem. A minor problem arises when the vehicle moves off or brakes fiercely: only the smaller wheel skids or drags.

The differential unit keeps the torque equal on both wheels. Torque is the product of tangential force of the wheel on the ground and the radius of the wheel. Consequently, the smaller wheel exerts greater force, equal to the torque divided by the radius of the wheel. Should this force exceed the friction force, then the wheel will skid. The larger wheel does not skid when wheel-friction coefficients are equal, since it applies less force to the ground, equal to the torque divided by the radius.

This phenomenon appears with different pumps connected to the differential unit, in accordance with the explanation and demonstration given below.

The following approximation is valid for pumps (equation 1):

$$T = \frac{Pq}{2} \qquad \text{(equation 1)}$$

where: T=torque;

P=increment of pressure;

q=relative volumetric flow; in other words, volumetric flow divided by pump-rotation frequency.

This equation deals with the power and product of the torque times the angular velocity which, in turn, is the product of 2p and the rotation frequency of the pump-shaft. Consider that power is the product of the pressure increment and the volumetric flow which, in turn, is the product of the relative volumetric flow times the rotation frequency of the pump-shaft. Consider also that there is no loss of energy.

Given the fact that the differential-action unit keeps the torque equal in the two pumps (14, 14'), the above equation produces the following equation 2:

$$P_{14}q_{14}=P_{14'}q_{14'} \qquad \text{(equation 2)}$$

where: indices 14 and 14' represent the pumps 14 and 14' respectively.

Therefore a smaller pump with a lower relative volumetric flow functions with a larger pressure increment, so as to hold constant the product of these two variables.

It also turns out from this equation that pumps of the same size and the same relative volumetric flow work at the same pressure increment.

When a given ratio of gas enters, the volumetric flow of pump 14 remains greater than that of pump 14', because gas is compressible, and the pressure in pump 14 is less than that of pump 14', since they are in a set. The shaft 13 rotates more rapidly than shaft 13' of pump 14', since the differential unit makes the necessary rotation compensation, in the same way as happens with a vehicle rounding a bend.

The rotation frequencies of the pump-shafts 13, 13' can be obtained by defining the relative volumetric flow (equation 3):

$$f_{14} = \frac{Q_{14}}{q_{14'}} \qquad f_{14'} = \frac{Q_{14'}}{q_{14'}} \qquad \text{(equation 3)}$$

where: Q=volumetric flow of fluids under the pump's pressure and temperature conditions.

These frequencies also depend on the rotation of the driving-shaft (equation 4):

$$f_m = \frac{f_{14} + f_{14'}}{2} \qquad \text{(equation 4)}$$

where: $f_m$=rotation frequency of the driving-shaft.

In the embodiment of FIG. 2 which illustrates a pumping system 20, when the required pressure increment is increased, two stages (pumps 25 and 25') may be insufficient. More pumps can be added, in a manner analogous to the four wheel traction of the vehicle in U.S. Pat. No. 4,577,721.

In FIG. 2, in the multi-phase pumping system 20 with 3 differential units and 4 stages, the drive-shaft 11 activates the first-level differential unit 22 which, in turn, activates the second-level differential units 23, 23', by means of two shafts 24, 24'. These differential units 22, 23, 23' activate pumps 25, 25', 25", 25'" by means of shafts 26, 26', 26", 26'". The pumps are connected in a set. Fluid enters by suction inlet 27, acquires rises in pressure at each pump 25, 25', 25", 25'", flows through the conduits 50, 51 and 52 and leaves through the discharge 34 of pump 25'".

The functioning of each pump 25'", 25", 25', is similar to that of the previous pump (25", 25', 25); in other words, differential units make the necessary rotation compensation, so that each pump 25, 25', 25", 25'" which forms a stage displays a volumetric flow controlled by the compressibility of the pumped fluid.

Multi-phase Pumping Systems with a raised number of stages can be produced by increasing the levels of differential units. For example, 3 levels of differential units produce a total of 7 differential units in 8 stages.

Generically, the number of stages is 2, raised to the number of levels of differential units, and the total number of differential units is equal to the number of stages minus one.

In the embodiment illustrated in FIG. 2, shafts 24, 24', 26, 26', 26", 26'", differential units 22, 23, 23' and pumps 25, 25', 25", 25'" display a symmetrical binary arrangement. By analogy with a tree, the drive-shaft 11 is the trunk; the remaining shafts 24, 24', 26, 26', 26", 26'" are the branches; and the pumps 25, 25', 25", 25'" are its fruit.

The quantity of differential units which activate a pump in a stage is equal to the quantity of differential units which activate the remaining pumps.

FIG. 3 illustrates a pumping system 30 which displays yet another embodiment with a symmetrical binary arrangement. Under this arrangement, a differential unit activates two different pieces of equipment, namely a pump and another differential unit, designed asymmetrically.

The drive-shaft 11 activates the differential unit $D_1$ which, in turn, activates the pump $B_1$ and differential unit $D_2$ by means of shafts $E_1$, $E_2$ respectively. The differential unit $D_2$ activates the pump $B_2$ and differential unit $D_3$ by means of the shafts $E_3$, $E_4$. This method of activation, a differential unit activating a pump and another differential unit, is repeated until the last differential-action unit $D_n$ activates two pumps $B_{n-1}$, $B_n$, by means of shafts $E_{n-1}$, $E_n$ respectively.

In this embodiment, the number of differential units activating a pump differs from the number of units of the remaining drawings, these exceptionally being pumps ($B_{n-1}$, $B_n$) which are activated by the maximum and same number of differential-action units.

The increase in speed at one output shaft of one differential unit takes place simultaneously with the corresponding decrease in speed at the other output shaft. Therefore, when one output shaft is halted, the rotation speed of the other output shaft is doubled compared with the input shaft's rotation or activation of the differential unit. This feature also turns the differential unit into a speed multiplier or speed reducer.

By way of illustration, a stage can rotate at 2, 4 or 8 times the speed of the multi-phase pumping system's drive-shaft at low or zero C.F. when it is activated by 1, 2 or 3 differential units respectively. Generically, the speed multiplier factor of any given stage may range up to 2, raised to the number of differential units it activates.

Therefore, the multiplier factor for the stages of the symmetrical pump with 8 stages activated is 8; in other words, a stage can rotate 8 times faster than the drive-shaft when all remaining stages are halted. The asymmetrical pump means that, from the first to the sixth stages, this factor will be 2, 4, 8, 16, 32 and 64 respectively. At the seventh and eighth stages, the factor is 128.

As previously mentioned in the present specification, the pumping systems under this invention envisage asymmetrical and symmetrical arrangements of the stages of the system in question.

With the design used in this invention, in the symmetrical pump arrangement a differential unit will activate similar devices, i.e. two differential units, thus creating the symmetry.

But with the asymmetrical pump arrangement, a differential activates two different devices, namely a pump and a different differential unit, thus creating the asymmetry.

Considering that the pump is multi-phase and that, when there is gas present, adjoining suction stages have to rotate at greater speeds than the discharge stages, one should preferably use an asymmetrical arrangement so that suction stages will be activated by more differential units than those of the discharge stages, as shown in FIG. 3.

However, an asymmetrical arrangement produces the disadvantage of causing a greater E.R.P. at the pumps that are activated by few differential units, since the torque activating a pump connected directly to a differential unit is equal to the torque activating all the remaining ones connected indirectly to that same differential unit.

Still further variants can be devised, combining one or more symmetrical binary arrangements with one or more asymmetrical binary arrangements, such variants falling within the scope of the invention.

Advantageously, according to the invention, any pump that comprises a stage can be disconnected or taken out for maintenance, with no need to disrupt pumping operations.

Figure 4:
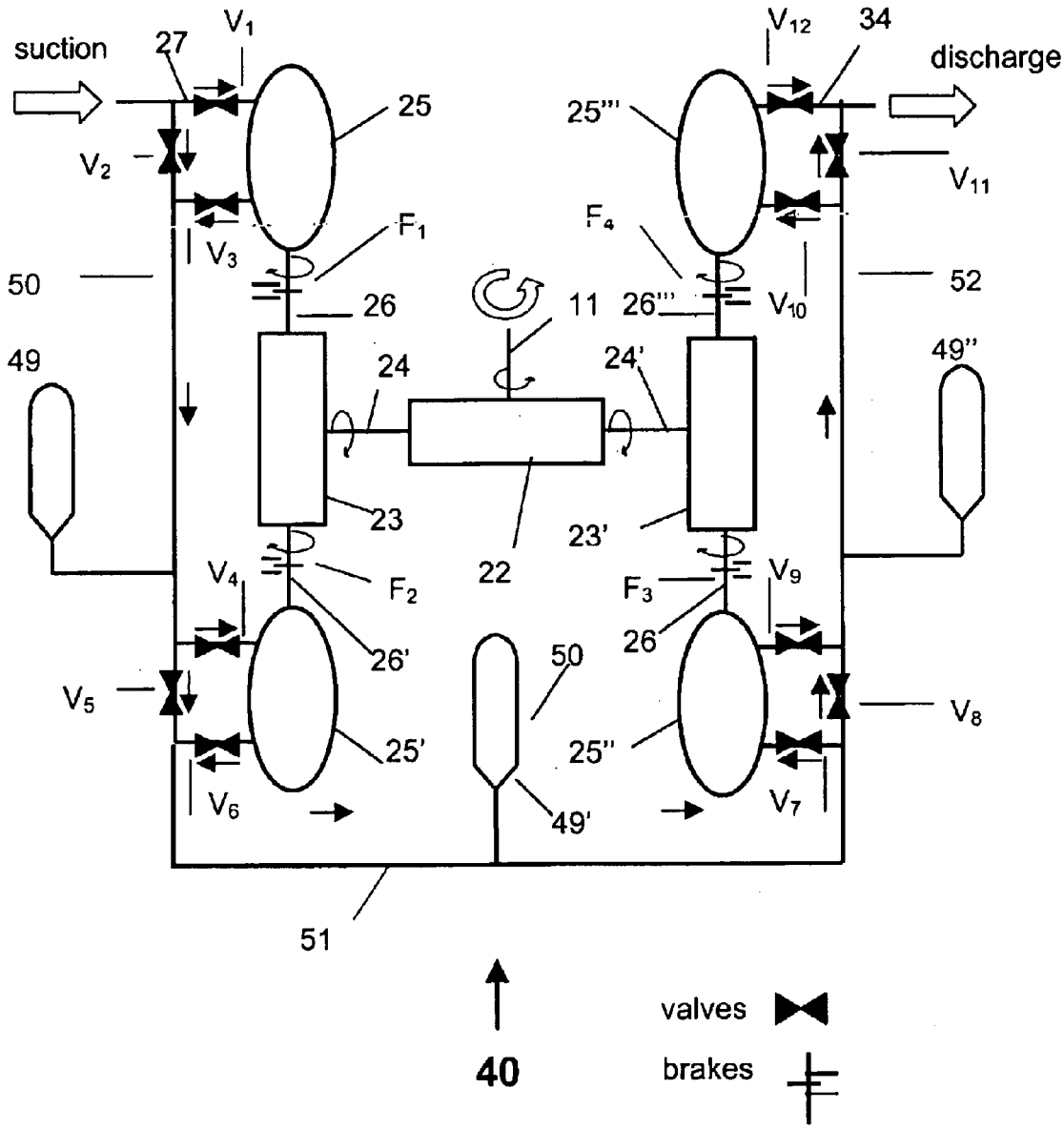
FIG. 4 illustrates an embodiment, also with three differentials and three accumulators.

For this purpose, diversions must be put in place in accordance with FIG. 4, which illustrates the pumping system 40 with a by-pass, facilitating diversion of drainage away from the pump that is out of commission.

In addition, the shaft that activates this ineffective pump must be shut down, for example, by means of conventional brakes, $F_1$ *to* $F_4$, in order that the remaining pumps will not stop working. The brakes used in this invention system are conventional brakes, similar to those used in motor vehicles, for example: with friction through canvas, asbestos, rubber, wood, metal or other suitable materials. Activation can be hydraulic, mechanical, electrical, etc.

Similarly, in the four-wheel traction vehicle of U.S. Pat. No. 4,577,721, when a wheel is taken off or loses contact with the ground, if the free axle has not been shut down, its rotation will be at maximum and the torque of the remaining wheels will be zero; in other words, the vehicle will not move.

This phenomenon arises because the mechanical differential unit always keeps up the same torque in all wheels or pumps and, obeying the law of action and reaction, the differential unit will not succeed in increasing torque while a wheel or pump is free, despite activating it at the highest possible rotation reached while the remaining wheels or pumps remain stopped.

U.S. Pat. No. 4,109,595 describes a multiple-differential unit used in the textile industry. By analogy with this earlier patent, any pump that forms a stage can be taken out and an extra motor installed in its place. In this case, a shaft that was activating a pump becomes a drive-shaft. The reverse also applies; any drive-shaft can be converted into a shaft activating a pump. Obviously, there must also be at least one pump and one motor connected to the system.

Accordingly, U.S. Pat. No. 4,109,595 shows that the differential units can also be installed in a compact manner, eliminating interconnecting shafts, thus forming a unique multiple-differential unit.

In the pumping system 40 in FIG. 4, collection vessels 49, 49', 49" and collection conduits 50, 51, 52 must be used between the stages in order to reduce sudden changes in pressure which appear when the pumps of the stages are not synchronised.

Collection conduits 50, 51, 52 are the conduits that interconnect the pumps. For the conventional conduits they become receptacles; their diameters and lengths or travels must simply be increased in size, so as to produce an internal volume similar to that of a conventional collector.

Valves $V_1$ to $V_{12}$ are conventional shut-off valves: butterfly, ball, needle, sphere, etc. They make it possible to take out items of equipment for maintenance, so minimising leakage. They also facilitate diverting the drainage of equipment, thus increasing operational flexibility, as described earlier in this specification.

Another aspect of the invention relates to the method of using the multi-phase pumping system described.

Thus, in FIG. 1, one embodiment of the method according to the invention for use of the pumping system for multi-phase fluids covers a symmetrical arrangement of pumps and differential units, which includes:

a) Supplying a driving-shaft (11) to start up a differential unit (12);

b) Supplying two shafts (13, 13') connected, respectively, to two pumps (14, 14'), said shafts (13, 13') transmitting rotation movement from the differential unit (12) to said pumps (14, 14');

c) Supplying collection channel (19) in order that the fluid can travel from pump (14) to pump (14');

d) Said pumps (14, 14') compressing multi-phase fluid in two stages so that the drive-shaft (11) transmits pressure through pumps (14, 14') to the multi-phase fluid, liquid or gas in any ratio, to be pumped. This fluid is drawn through a suction-pipe (15) to a first pump (14) where its pressure rises, it is discharged through the discharge pipe (16) of the pump (14), it flows through a collection conduit (19) and enters through the suction pipe (17) of a second pump (14') where there is a further rise in pressure, and it is finally discharged through the discharge pipe (18) of that second pump (14'), the differential-action unit (12) making the necessary rotation compensation, so that each pump (14, 14') displays a volumetric flow controlled by the compressibility of the fluid, such that the C.F. of the fluid is reduced or eliminated altogether.

In FIG. 2, a different embodiment of the method according to the invention with a symmetrical arrangement of pumps and differential includes:

a) supplying a drive-shaft (11) to start up a first differential unit (22);

b) supplying shafts (24, 24") connected to the first differential unit (22) in order to transmit rotation movement to two differential units (23, 23'), connected to shafts (24, 24'), to transmit movement from shafts (24, 24') to shafts (26, 26', 26", 26'");

c) supplying collection conduits (50, 51, 52) in order that fluid will pass to pumps (25', 25" and 25'");

d) said shafts (26, 26', 26", 26'") being connected to the two differential units (23, 23') in order to transmit rotation movement, respectively, to four pumps (25, 25', 25", 25'");

e) said pumps (25, 25', 25", 25'"), being installed so that driving-shaft (11) connected to the first differential unit (22) and this differential unit (22) is connected to shafts (24, 24') which are connected to differential units (23, 23') which in turn are connected to pumps (25, 25', 25", 25'") by means of shafts (26, 26', 26", 26'") transmit pressure through pumps (25, 25', 25", 25'") to multi-phase fluid, liquid or gas in any ratio, for pumping, said fluid being drawn through a suction pipe (27) to a first pump (25) where there is a rise in pressure, being discharged through the discharge pipe (28) of said pump (25), flowing through a collection channel (50), entering through the suction pipe (29) of a second pump (25') where there is a further rise in pressure, is discharged through the discharge pipe (30) of that pump (25'), flowing through a collection conduit (51), entering through the suction pipe (31) of a third pump (25") where there is yet another rise in pressure, being discharged through the discharge pipe (32) of that pump (25"), flowing through a collection conduit (52), being drawn through the suction pipe (33) of a fourth pump (25'") where it gains yet more pressure, and being finally discharged through the discharge pipe (34) of that fourth pump (25'"), the differential-action units (22, 23, 23') making the necessary rotation compensation, so that each pump (25, 25', 25", 25'") displays a volumetric flow controlled by the compressibility of the fluid pumped in such a way that the C.F. of the fluid is reduced or eliminated altogether.

According to FIG. 3, yet another embodiment of the method according to the invention covers an asymmetrical binary arrangement of pumps and differentials, including:

a) supplying a drive-shaft (11) to start up a first differential unit ($D_1$);

b) supplying shafts ($E_1$, $E_2$) connected to differential unit ($D_1$) in order to transmit rotation movement to a pump ($B_1$) and a second differential unit ($D_2$);

c) supplying a set of shafts ($E_3$, $E_n$) which transmit rotation to a set of differential units ($D_3$, $D_n$);

d) said set of differential units which in turn transmitting rotation to a set of a pumps ($B_2$, $B_n$) through shafts ($E_3$, $E_n$);

e) supplying collection conduits ($L_1$, . . . $L_n$) in order that fluid will drain off to the aforementioned pumps.

f) said set of pumps ($B_2$, $B_n$) being installed in such a way that the drive-shaft transmits pressure through the pumps ($B_1$, $B^n$) to the multi-phase fluid, liquid or gas in any ratio, for pumping, the fluid being drawn through a suction pipe ($S_n$) to the pump ($B_n$) where there is a rise in pressure, being discharged through the discharge pip ($G_n$) of said pump ($B_n$), flows through a collection channel ($L_n$), entering through the suction pipe ($S_{n-1}$) of the next pump ($B_{n-1}$) where there is a further rise in pressure, and so on sequentially until it is finally discharged through the discharge pipe ($G_1$) of pump ($B_1$), the differential units ($D_1$, $D_n$) making the necessary rotation compensation, so that each pump ($B_1$, $B_n$), displays a volumetric flow controlled by the compressibility of the pumped fluid, through which the C.F. of that fluid is reduced or eliminated altogether.

According to FIG. 4, which shows a variant of the method of the invention following the method of FIG. 2, collection vessels (49, 49', 49") or collection conduits (50, 51, 52) are added, which must be used between the stages, in order to reduce sudden changes in pressure that appear when the pumps of the stages are not synchronised.

Therefore, according to the invention, it is possible to prevent C.F, making all a pump's stages work at the same volumetric flow when only liquid is entering. When gas is entering, the stages next to the pump suction must work with a volumetric flow greater than the flow of the stages next to the discharge.

In other words, when the physical state of the fluid entering a system pump is not known, regardless whether it be liquid, gas or liquid and gas, the pump must show stages with a variable volumetric flow.

Varying the rotation of one stage in relation to another is a way of varying the volumetric flow of one stage in relation to the other.

The differential makes it possible to vary the rotation between stages easily and automatically.

The efficiency of prior art multi-phase pumps can show low values, in the region of 3%, when they are pumping only gas. The efficiency of these pumps is generally close to the proportion of liquid entering into pump suction. For example, when there is 70% gas, the liquid proportion is 30%, and consequently its energy-efficiency is approximately 30%.

The decline in efficiency of these pumps with increases in the proportion of gas occurs because the gas causes C.F. Since C.F. is reduced or eliminated with the design of the present invention, its energy-efficiency remains virtually equal to that of a conventional pump that pumps only liquid, or a compressor that pumps only gas; in other words, there is high energy efficiency for any given ratio of liquid and gas, in the region of 90%.

The design of the present invention incorporates separate differential units and pumps. However, the combined application incorporates different types of differential units and different types of pumps, producing multi-phase pumps, as shown by the drawings and description.

Although the invention has been described primarily for oil-based fluids, it is equally applicable to any multi-phase fluid with differing physical or chemical properties, and to other industrial processes:

1. any process whereby liquids and gases are separated for pumping;
2. where separation is inefficient and gas is mixed with liquid, reducing pump efficiency, allowing possible cavitation, which damages the pump;
3. where separation is inefficient and the liquid is mixed with gas and enters a compressor, causing hydraulic hammering, which damages the compressor;
4. in compressors, where gases condense during the compression process, likewise causing hydraulic hammering;
5. where it would be beneficial to transport mixed liquid and gas, preventing separation or at least displacing it to a more suitable location;

There follow some examples of its application of the invention:

1. a saturated steam pump;
2. a water-pump operating below the net positive suction head (NPSH) of the pump;
3. pumping of any liquid when the pump suction pressure declines down to the liquid vapour pressure, with vaporisation of the liquid upon suction by the pump, in other words, the presence of both liquid and gas phases;
4. pumping of pastes and viscous liquids, where segregation or separation of gas is difficult;
5. compression of natural gas, liquefied petroleum gas (LPG), Freon or gases having components that condense at pump pressure.

What is claimed is:

1. A multi-phase pumping system with two or more pump stages that operate with zero or low circulatory-flow (CF) of fluids between stages, with mixed binary symmetrical and asymmetrical arrangements, for pumping liquid, gas, or liquid and gas simultaneously, comprising:

mechanical differentials capable of varying rotation between respective pump stages;

a drive-shaft to activated one said mechanical differential;

shafts activated by said one mechanical differential for transmission of the rotating movement of said one mechanical differential to remaining mechanical differentials and to pumps at several stages of compression with variable rotation, the pumps being fitted with an input for suction of the multi-phase fluid to be pumped, and an output to discharge the fluid; and fluid flow conduits connecting the respective next pump input with the output of the respective preceding pump to discharge said fluid: said pumps being activated respectively by the shafts;

whereby the multi-phase fluid fed into the preceding pump, is passed onto the next pump whence it is discharged under pressure, which is increased in relation to the pump discharge pressure of the preceding pump;

so that each pump presents a volumetric flow controlled by the compressibility of the pumped fluid, wherein that the circulatory-flow of said fluid in said stages is reduced or eliminated.

2. System according to claim 1, wherein each pump includes one stage.

3. System according to claim 1, wherein each pump includes several stages.

4. System according to claim 1, wherein the arrangement of pumps and mechanical differentials is symmetrical.

5. System according to claim 1, wherein the arrangement of pumps and mechanical differentials is asymmetrical.

6. System according to claim 1, further comprising valves in the inputs, outputs, or fluid flow conduits therebetween.

7. System according to claim 1, further comprising brakes able to act on the shafts between the mechanical differentials and the pumps.

8. System according to claim 1, further comprising collection vessels to collect the pumped fluid.

9. System according to claim 1, wherein the pumps are of the piston type, diaphragm or gear type, or single or multiple-screw, Moineau, helico-axial or centrifugal pumps.

10. System according to claim 1, comprising includes n pumps and n−1 mechanical differentials.

11. System according to claim 1, wherein one or more of said mechanical differentials are multi-differentials comprising directly interconnected mechanical differentials without connecting shafts therebetween.

12. Multi-phase pumping method for fluids sourced from oil- or gas-wells, using the system a according to claim 1, including:

a) providing said drive-shaft to activate said mechanical differential;

b) providing said shafts connected respectively to the pumps, said shafts transmitting rotation movement from said mechanical differential to said pumps;

c) operating said pumps to compress a multi-phase fluid in n stages, so that the drive-shaft transmits pressure through the pumps (B1, . . . Bn) to the multi-phase fluid, liquid and gas, to be pumped; drawing said fluid through the input of a first one of said pumps(Bn) where its pressure is increased; discharging it through the output from said first pump (Bn); flowing it through the fluid flow conduit to enter the input a the next pump (Bn−1), where pressure is increased further; and finally discharging it through the output of a final one of said pumps (B1), wherein the mechanical differentials make the correct rotation compensation, so that each pump (B1, . . . Bn) presents a volumetric flow controlled by the compressibility of the pumped fluid, in such a way that the circulatory-flow of the fluid is reduced or eliminated.

13. Method according to claim 12, wherein the arrangement of the pumps and mechanical differentials is symmetrical.

14. Method according to claim 12, wherein the multi-phase fluid includes oil, gas and water.

* * * * *